United States Patent [19]

Iwai

[11] 4,239,372

[45] Dec. 16, 1980

[54] TRANSFER TYPE ELECTROPHOTOGRAPHIC COPYING MACHINE

[75] Inventor: Fumio Iwai, Hachioji, Japan

[73] Assignee: Konishiroku Photo Industry Co., Ltd., Tokyo, Japan

[21] Appl. No.: 953,348

[22] Filed: Oct. 23, 1978

[30] Foreign Application Priority Data

Oct. 27, 1977 [JP] Japan ..... 52-129150

[51] Int. Cl.[3] ..... G03G 15/00

[52] U.S. Cl. ..... 355/14 R; 118/679; 355/3 DD; 355/10; 355/14 D; 355/14 TR

[58] Field of Search ..... 355/14, 3 DD, 3 R; 118/7; 250/206

[56] References Cited

U.S. PATENT DOCUMENTS

| | | | |
|---|---|---|---|
| 3,360,652 | 12/1967 | Bernous | 355/14 X |
| 3,801,196 | 4/1974 | Knapp et al. | 355/3 R |
| 4,050,806 | 9/1977 | Miyakawa et al. | 355/14 |

*Primary Examiner*—R. L. Moses

*Attorney, Agent, or Firm*—Bierman & Bierman

[57] ABSTRACT

In a transfer type electrophotographic copying machine, the amount of supplied toner is controlled in accordancw with the voltage developed by the reflection of light from an indexing image developed on the photosensitive member before or behind the transferred developed image; the same reflected light also detects the presence of an unseparated transfer sheet to stop the machine.

1 Claim, 5 Drawing Figures

TRANSFER TYPE ELECTROPHOTOGRAPHIC COPYING MACHINE

This invention relates to a transfer type electrophotographic copying machine having a photoelectric detecting means available to control toner replenishment and to stop the copying operation.

In the operation of an electrophotographic copying machine, an electrostatic latent image produced on a sensitive plate is developed using a mixture of a toner and a carrier mixed in a certain proportion and reserved in a container. The optical toner density of the copied image has a tendency to decrease due to the reduction of the proportion of the toner in the mixture during repetition of the copying cycle. To prevent this undesirable tendency, the toner has been heretofore supplied from a toner supply container into the container of the developing agent at fixed intervals of time. However, the rate of consumption of the toner being different depending on the specific requirement of copies, the proportion of the toner in the mixture is impossible to compensate by supplying the toner at a fixed period of time, consequently, the optical toner density of the copied image cannot be kept constant according to the method described above.

A variety of methods have been introduced to keep at constant the proportion of the toner in the mixed developing agent filled in the container, for instance, a method of measuring the transmissivity of the toner in the container by means of photoelectric cells, a method of measuring the electric resistance of the mixture of the toner and the carrier, a method of measuring the reflectivity of the mixture by means of photoelectric cells, and a method of measuring the density of a sensible image developed from a permanent electrostatic latent image provided permanently around the edge of the sensitive drum. However, these methods have the disadvantage that the accuracy of detection of the density of tht toner is not satisfactory.

According to the present invention, the toner supply is accurately controlled in proportion to the density of the toner by the output of a comparison module, produced by detecting with photoelectric transducers photoelectric detecting means mounted between the separating and cleaning position, the reflection from a toner density control image produced in the developing process at the same time with the copy image, by developing a latent image of a toner control index image provided on the front or rear end outside the copying area of a photosensitive member at every exposure of copies and an index image which is provided on the front or rear end of the copy board, while the clogging of paper is prevented by stopping the copying operation at the detection of failure of separation of a copied paper from the sensitive member by photoelectric detecting means.

The present invention will be explained by referring to FIGS. 1 to 5.

Figure 1:
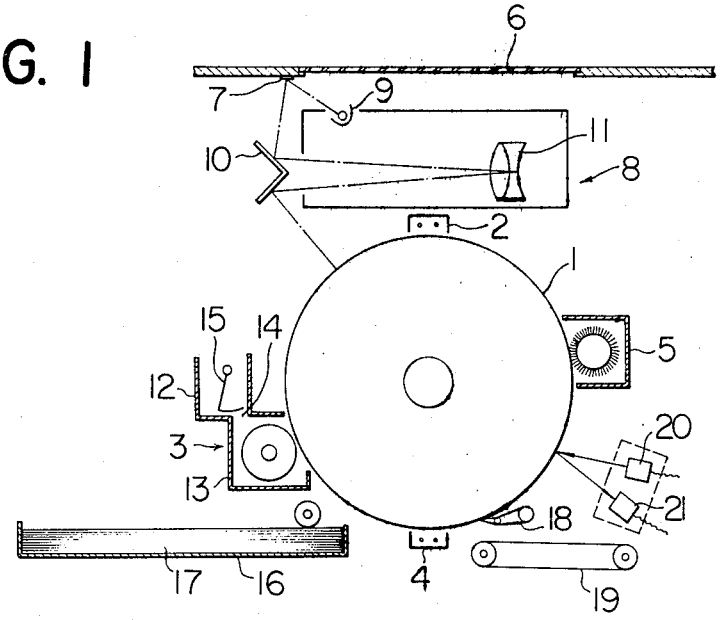
FIG. 1 is a schematic elevation of an embodiment of the present invention.
Figure 2:
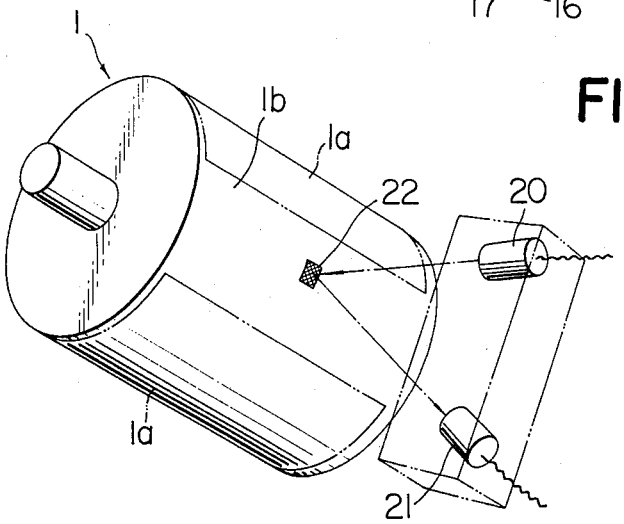
FIG. 2 is a perspective view illustrating the detection of the toner density.
Figure 3:
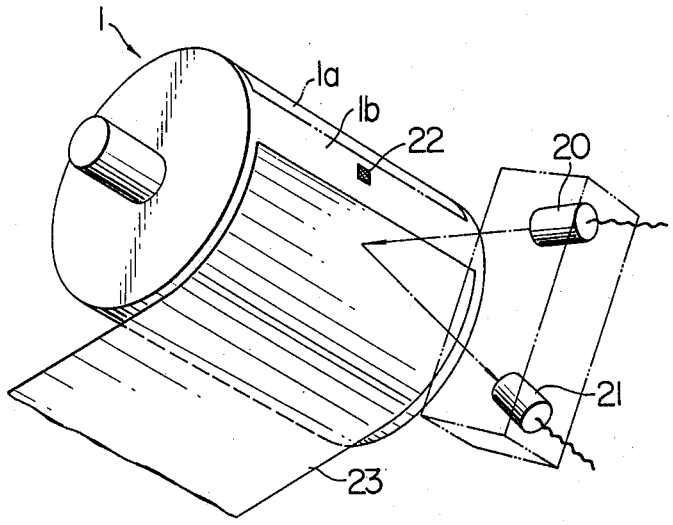
FIG. 3 is a perspective view illustrating the detection of an unremoved copying paper.

Referring first to FIGS. 1 to 3, explanation will be made on a preferred embodiment of the copy machine according to the present invention utilizing a photosensitive member in the form of a rotary drum.

Mounted on a frame (not shown) is a photosensitive drum with a photosensitive members (1) having copying area **(1*a*) and front or rear end area (1*b*) outside the copying area (1*a*). A charging means (2), a developing means (3) a tranferring means (4) and a cleaning means (5)** are suitably disposed on the frame around the photosensitive drum.

Numerals (6) designate a copy board, and (7) an index image provided on the front or rear end of the copy board (6) or the copy holding cover. An exposure device generally designated by (8) comprises a source of light (9), a mirror (10) and a lense (11). The exposure device (8) exposes the index image (7) and the copy at every copying cycle to produce the latent image of the index image (7) and the copy on the sensitive drum (1). A toner supply container (12) is provided above a developing agent container (13) connected thereto by an opening (14). The toner is supplied from the toner supply container (12) into the developing agent container (13) by the action of a reciprocating lever (15).

Reams of transfer sheet (17) prepared in a case (16) are fed one by one at every copying cycle to the transfer means (4) where the developed images on the photosensitive drum are transferred onto the transfer sheet, then the transfer sheet is separated from the photosensitive drum by a separating means (18) formed of a scraper or the like and delivered by a carrying means (19) to a fixing means, not shown, where the transferred image is fixed.

A light projecting element (20) and a light receiving element (21) are provided between the separating means (4) and the cleaning means (5). The light receiving element (21) receives the reflection of the light or ray, for instance infrared ray, projected from the light projecting element (20) and reflected on the surface of the photosensitive drum (1). The toner density control image (22), produced by developing while passing the developing means (3) reflects the light projected from the light projecting element (20) to the light receiving element (21). Whenever a specific transfer sheet (23) which has passed the transfer unit (4) has not been properly separated from the photosensitive drum (1) and adheres to the drum (1), the presence of said transfer sheet (23) is detected by the combination of the light projecting element (20) and the light receiving element (21).

Figure 4:
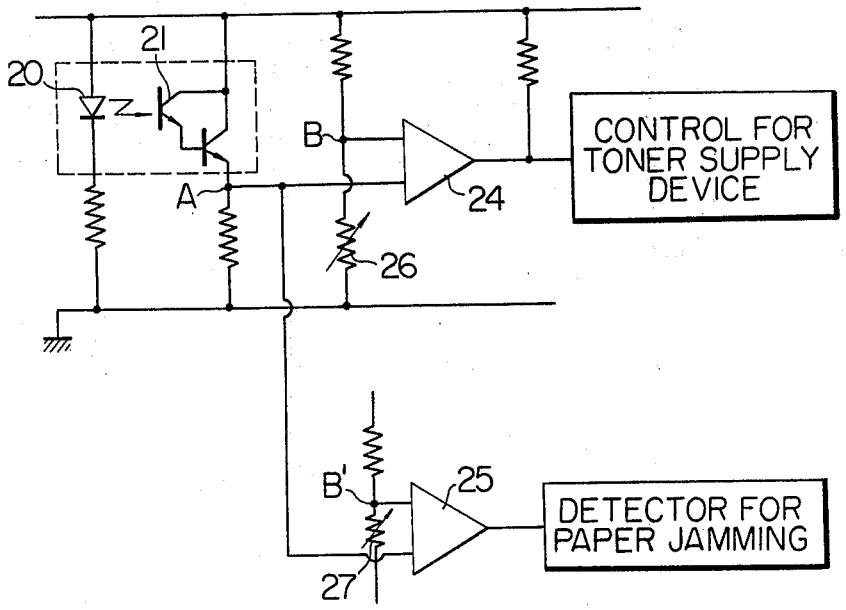
FIG. 4 is a circuit diagram of the detecting device which detects the toner density and the unremoved copying paper.

As shown in FIG. 4, comparison modules (24) and (25) are included in a detecting and controlling module comprised of electric components including the light projecting element (20) and light receiving element (21). The comparison module (24) is adjusted by means of a variable resistance (26) so that the electric potential at the point A, generated in proportion to the intensity of the reflection received from the image when the density corresponds to the standard density of the toner, and the electric potential at the point B are in equipotential. The comparison module (24) compares the electric potential at the point A, generated in proportion to the intensity of the reflection of the light projected from the light projecting element (20) against the toner control image exposed and developed on the photosensitive drum at every copying cycle and received by the light receiving element (21), with the previously set standard electric potential for the point A and judges the difference between those electric potentials. It then provides a signal to stop or to actuate the reciprocating lever (15) of the toner supplying container (12) controlling the supply of the toner into the developing agent container (13) in any well-known manner. The comparison module (25) is adjusted by means of a variable resistance (27) so that the electric potential at the point A, generated in proportion to the intensity of the reflection from the surface of the photosensitive drum (1) when the transfer sheet (23) is normally separated, and the electric potential at the point B' are in equipotential. The actuating timing of the comparison module (25) is shifted relative to that of the comparison module (24). The separation of the transfer sheet (23) is detected at every copying cycle by projecting light from the light projecting element (20) and when the copying paper (23) is unduly adhering to the sensitive rotary drum (1), the electric potential at the point A differs from the previously set standard electric potential for the point A, consequently, the comparison module (25) judges the difference and gives a signal to stop the driving system of the copy machine.

In the operation of the device described above, the photosensitive drum rotates one turn every copying cycle. First the photosensitive drum (1) is charged by the charging means (2) and then the original to be copied prepared on the copy board (6) is exposed on the copying area (1*a*) of the photosensitive drum (1) by the exposing means (8) while the index image (7) also is exposed to produce a latent image on the front or rear end area (1*b*) outside the copying area of the photosensitive drum (1) by the exposing means (8). Then, the developing means (3) develops the latent index image and the latent image of the original to be copied so that the toner control image (22) and the image of the original are produced. The density of the developed images depends upon the proportion of the toner in the mixture contained in the developing agent container (13). As the front part of the copying area approaches the transferring means (4) according to the rotation of the photosensitive drum (1), a transfer sheet (17) is fed to the transfer means (4) where the developed image of the original produced within the copying area (1*a*) of the photosensitive drum (1) is transferred onto the tranfer sheet (17) while the toner control image is not transferred onto the transfer sheet (17) because it is produced on the front or rear end area (1*b*) outside the copying area.

Consequently, when the toner control image (22) reached the detecting position according to further rotation of the photosensitive drum (1), the light projecting element (20) projects light against the toner control image (22) and the light receiving element (21) detects the reflection. The comparison module (24) compares the couput voltage of the light receiving element (21) with the previously set standard voltage corresponding to the standard density, then provides a signal when the equilibrium between the standard voltage and the detected voltage is destroyed either to stop the reciprocating lever (15) of the toner supplying container (12) until the toner density of the toner control image agrees with the standard density, or to actuate the reciprocating lever (15) depending on the level of the output voltage of the light receiving element (21) relative to the level of the standard voltage, so that the toner supply into the developing agent container (13) is controlled to maintain the density of the copies at constant density automatically.

The photosensitive drum rotates further and the toner control image (22) and the image of the copy still remaining on the sensitive rotary drum after the transfer are cleaned off by the cleaning means (5), thus completing a copying cycle.

The transferred copying paper (23) ordinarily is removed from the photosensitive drum (1) with the separating means (18), delivered to the fixing device by the carrying means (19) and fixed. When the transferred transfer sheet (23) cannot be removed by the separating means (19) and advances adhering to the photosensitive drum (1) as far as the detecting position, the comparison module (25) detects the change of the output voltage of the light receiving element (21) caused by the change of the reflection of the light projected from the light projecting element (20) and provides a signal to stop the driving system of the copying machine preventing the clogging of the transfer sheet.

Figure 5:
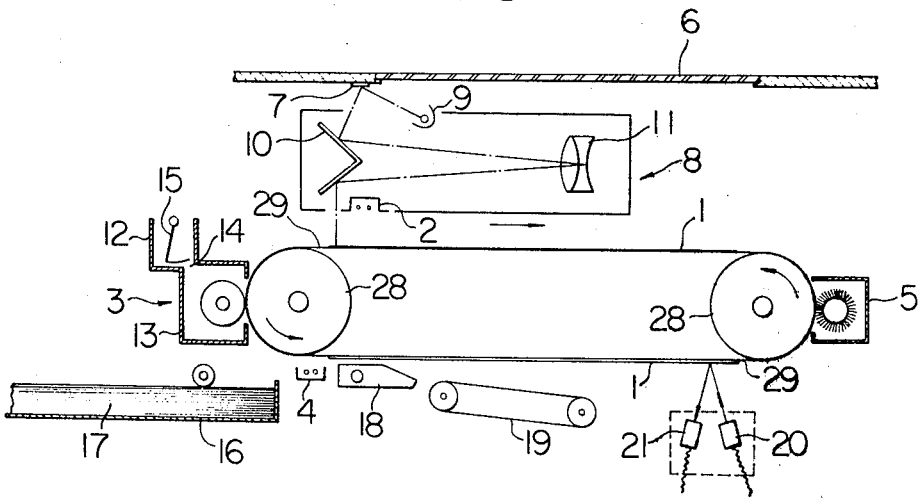
FIG. 5 is a schematic elevation of another embodiment of the present invention.

Referring to FIG. 5 illustrating another preferred embodiment according to the present invention, the photosensitive member is provided on an endless belt (29) extended between rollers (28*s*) instead of the drum of the first embodiment, wherein like numerals designate like parts or components and the operation of the machine is identical with that of the first embodiment as described above.

According to the present invention, the density of the transferred image is detected at every copying cycle and compensation of the density is made, therefore, the image is maintained at constant toner density if the characteristic of the photosensitive member has changed due to deterioration or if the quantity of the toner transferred to the photosensitive member has changed due to deterioration of the developing agent. Furthermore, the construction is simplified and the dimension of the machine is reduced as the toner density and unremoved transfer sheet are detected by means of a single combination of a light projecting element and a light receiving element.

What we claim is:

1. In a transfer type electrophotographic copying machine having a movable photosensitive member, change means therefor, a copy board adapted to support an original to be copied, means for illuminating said original, an optical system for producing an image of the illuminated original upon the charged photosensitive member, developing means for developing the image of the original on said member, means transferring the developed image to a transfer sheet of predetermined length in contact with said photosensitive member, means separating the transfer sheet from the photosensitive member, and cleaning means for cleaning said photosensitive member after the developed image has been produced, the improvment comprising an indexing image mounted adjacent one end of said copy board in the path of said illuminating means and said optical system and in longitudinal alignment with the original to be copied, whereby said indexing image is developed on said photosensitive member upon an area not occupied by the reproduced image of the original but in the path of said developing means and intermediate both the ends of the produced image of the original and of the ends of the transfer sheet, a single source of light directed against said photosensitive member in the path of both said reproduced image of the original and the reproduced image of said indexing image, said light source being positioned intermediate said separating means and said cleaning means relative to said photosensitive member, means measuring the amount of light reflected by said light source from said photosensitive member, said last means producing a voltage in accordance with the amount of reflected light, means controlling the amount of toner fed to said developing means, means for halting operation of said copying machine, first comparison means for comparing the voltage produced by said single source of light as reflected by said reproduced indexing image against a predetermined voltage standard which is adapted to actuate said toner controlling means, and a second comparison means for comparing the voltage produced by the same light from said single source that is reflected from said photosensitive member in the presence or absence of a transfer sheet which is adapted to halt operation of said copying machine if a transfer sheet is present.

* * * * *